US008957828B2

(12) United States Patent
Jonsson et al.

(10) Patent No.: US 8,957,828 B2
(45) Date of Patent: Feb. 17, 2015

(54) ANTENNA ARRANGEMENT FOR A MULTI RADIATOR BASE STATION ANTENNA

(75) Inventors: Stefan Jonsson, Stocksund (SE); Dan Karlsson, Solna (SE)

(73) Assignee: Cellmax Technologies AB, Kista (SE)

( * ) Notice: Subject to any disclaimer, the term of this patent is extended or adjusted under 35 U.S.C. 154(b) by 419 days.

(21) Appl. No.: 12/679,533

(22) PCT Filed: Sep. 19, 2008

(86) PCT No.: PCT/SE2008/051053

§ 371 (c)(1), (2), (4) Date: Mar. 23, 2010

(87) PCT Pub. No.: WO2009/041895

PCT Pub. Date: Apr. 2, 2009

(65) Prior Publication Data

US 2010/0201593 A1 Aug. 12, 2010

(30) Foreign Application Priority Data

Sep. 24, 2007 (SE) ..... 0702123

(51) Int. Cl.

| | |
|---|---|
| ***H01Q 21/08*** | (2006.01) |
| ***H01Q 21/26*** | (2006.01) |
| ***H01P 1/18*** | (2006.01) |
| ***H01Q 1/24*** | (2006.01) |

(52) U.S. Cl.

CPC ..... *H01Q 1/246* (2013.01)
USPC ..... 343/853; 343/797; 343/814; 333/160

(58) Field of Classification Search

USPC ..... 343/795, 797, 810, 812–814, 816, 824, 343/815, 853; 333/160
See application file for complete search history.

(56) References Cited

U.S. PATENT DOCUMENTS

| | | | | | |
|---|---|---|---|---|---|
| 2,573,914 | A | * | 11/1951 | Landon | 343/795 |
| 2,760,193 | A | | 8/1956 | Riblet | |
| 3,617,953 | A | * | 11/1971 | Kingma et al. | 333/17.1 |
| 3,656,167 | A | | 4/1972 | Lea | |
| 4,031,535 | A | * | 6/1977 | Isbister | 342/46 |
| 4,686,536 | A | | 8/1987 | Allcock | |
| 4,788,515 | A | | 11/1988 | Wong et al. | |

(Continued)

FOREIGN PATENT DOCUMENTS

| | | | |
|---|---|---|---|
| GB | 954097 | A | 4/1964 |
| JP | 6-204718 | A | 7/1994 |

(Continued)

OTHER PUBLICATIONS

Hideyuki, O, et al.: "Broadband Directional Coupler Using Dielectric Loaded Slit". Ieee mtt-s Digest, 1993, pp. 873-876.

(Continued)

*Primary Examiner* — Michael C Wimer
(74) *Attorney, Agent, or Firm* — The Jansson Firm; Pehr B. Jansson

(57) ABSTRACT

Antenna arrangement for a multi radiator base station antenna, the antenna having a feeding network based on air filled coaxial lines (15; 19), wherein the coaxial line being an integrated part of a back side of an antenna reflector (1), and wherein the coaxial line comprises an outer conductor (9) and an inner conductor (7; 14). Two parallel columns of radiators (11) are placed on a front side of the antenna reflector (1), the radiators (11) being fed from said feeding network.

13 Claims, 4 Drawing Sheets

(56) References Cited

U.S. PATENT DOCUMENTS

| | | | | |
|---|---|---|---|---|
| 5,086,304 | A * | 2/1992 | Collins | 343/778 |
| 5,339,058 | A | 8/1994 | Lique | |
| 5,543,000 | A | 8/1996 | Lique | |
| 5,801,600 | A | 9/1998 | Butland et al. | |
| 5,949,303 | A | 9/1999 | Arvidsson et al. | |
| 6,067,053 | A | 5/2000 | Runyon et al. | |
| 6,118,353 | A | 9/2000 | McKay | |
| 6,222,499 | B1 | 4/2001 | Goetz et al. | |
| 6,229,327 | B1 | 5/2001 | Boll et al. | |
| 6,333,683 | B1 | 12/2001 | Hampel | |
| 6,356,245 | B2 | 3/2002 | Metzen et al. | |
| 6,480,163 | B1 | 11/2002 | Knop et al. | |
| 6,563,399 | B2 * | 5/2003 | Love | 333/156 |
| 6,683,582 | B1 * | 1/2004 | Love | 343/853 |
| 6,756,948 | B2 * | 6/2004 | Love | 343/778 |
| 6,940,465 | B2 | 9/2005 | Gottl et al. | |
| 7,132,995 | B2 | 11/2006 | Gottl | |
| 2002/0101388 | A1 | 8/2002 | Ippolito | |
| 2002/0135520 | A1 | 9/2002 | Teillet et al. | |
| 2004/0145526 | A1 * | 7/2004 | Puente Baliarda et al. MS | 343/700 |

FOREIGN PATENT DOCUMENTS

| | | | |
|---|---|---|---|
| SE | WO2005101566 | A1 | 10/2005 |
| WO | WO98/09348 | A1 | 3/1998 |
| WO | WO0235651 | A1 | 5/2002 |
| WO | WO2005/101566 | A1 | 10/2005 |

OTHER PUBLICATIONS

PCT/SE2005/000548 International Search Report, Jul. 6, 2005, Swedish Patent Office Box 5055, S-102 42 Stockholm, Sweden.

CN1950973A Chinese Application No. 200580011198.2 text Portion of the Notification of the First Office Action.

PCT/SE2005/000548 Written Opinion of the International Searching Authority, Jul. 6, 2005, Swedish Patent Office Box 5055, S-102 42 Stockholm, Sweden.

Intent to Grant, European Patent Application 08834090.6-2220 070120EP Oct. 12, 2012, European Patent Office, 80298 Munich, Germany.

Response to Communication pursuant to Rules 70(2) and 70a(2) EPC dated Oct. 21, 2011 Apr. 4, 2012, European Patent Application 08834090.6, Apr. 4, 2012, Stockholm, Sweden SE-10055.

European Search Report, European Patent Application 08834090.6-2220, Apr. 10, 2011.

PCT/SE2008/051054 International Search Report, Jan. 12, 2009, Swedish Patent Office Box 5055, S-104 42 Stockholm.

Response to Communication pursuant to Rules 70(2) and 70a(2) EPC, dated Jan. 14, 2014, European Patent application No. 08832815.8, Stockholm, Sweden.

08832815.8 Extended EP Search Report, Jun. 17, 2013, European Patent Office 80298 Munich, Germany.

* cited by examiner

ANTENNA ARRANGEMENT FOR A MULTI RADIATOR BASE STATION ANTENNA

BACKGROUND OF THE INVENTION

The present invention relates to an antenna arrangement for a multi radiator base station antenna, the antenna having a feeding network based on air filled coaxial lines, wherein the coaxial lines are an integrated part of the antenna reflector. The invention especially relates to such a dual polarised antenna having two parallel columns with dual polarised radiators.

Antennas in telecommunication systems such as cellular networks today typically use multi-radiator structures. Such antennas make use of an internal feeding network that distributes the signal to the radiators from a common coaxial connector when the antenna is transmitting and in the opposite direction when the antenna is receiving. Typically radiators are positioned in a vertical column and radiators are fed via a feeding network from a common connector in a single polarisation antenna case, or fed via two feeding networks from two connectors in a dual polarisation case. This vertical column arrangement reduces the elevation beam width of the antenna and increases the antenna gain.

For a single-column antenna, the azimuth beam width is determined by the shape of the reflector and the radiator. Approximately, antenna gain is inversely proportional to the antenna beam width. In order to make a narrow azimuth beam width antenna two or more columns of radiators are typically used. Typical applications are road or railroad sites, or sites that use six sectors instead of the commonly used three sectors. For road and railroad sites, higher antenna gain allows the operator to use a larger distance between sites. A six-sector site can be used to increase the capacity of a cellular network without increasing the number of sites, or to increase the area coverage of a given site by using antennas with higher gain achieved by the narrower azimuth beam width.

Today, cellular antennas often have radiators that can radiate in two orthogonal polarisations. Each polarisation is associated to a feeding network. Thus, two orthogonal channels are created that can be connected to a diversity receiver in the base station. Using diversity reduces fading dips and thus enhances the sensitivity of the receiver. In order for the diversity to be efficient, the signals from the two channels must be sufficiently uncorrelated. Therefore it is necessary to maintain certain isolation between the two channels. For diversity purposes 20 dB isolation is enough, but customers usually specify 30 dB due to filter specification issues in the base station.

For a two-column antenna, the azimuth antenna pattern primarily depends on a complex interaction between the width and shape of the reflector, the radiation pattern of the radiators and the separation between the radiators. It is often difficult to combine high gain with low azimuth side lobe level. Low azimuth side lobe level is important in order to reduce interference from neighbouring sectors.

SUMMARY OF THE INVENTION

The object of the present invention is therefore to provide a novel narrow azimuth beam dual polarised antenna having higher gain than presently available antennas together with low azimuth side lobe level and sufficient isolation between channels.

This object is obtained with an antenna, wherein two parallel columns of radiators are placed on the reflector front side, and the radiators are fed from a feeding network on the back side of the reflector.

The present invention relates to a two-column antenna that uses a low loss feeding network similar to that described in applicant's earlier application WO 2005/101566 A1, now U.S. Pat. No. 7,619,580. In FIG. 1 is shown an embodiment of a two-column antenna with 32 radiators. To reduce the number of parts, it is beneficial to re-use the same feeding network for both antenna columns as much as possible. In this embodiment, only the coaxial lines that link two radiators in pairs are duplicated, all other coaxial lines are common for both antenna columns.

The antenna feeding network uses a number of splitters/combiners (reciprocal networks) that split/combine the signal in two or more. In order to simplify the text, only the splitting (transmitting) function is described. The splitter/combiner is fully reciprocal which means that the same type of reasoning can be applied also to the combining (receiving) function.

It can be seen from FIG. 1 that it is necessary for signal paths to cross each other. Conventional two-column antennas use coaxial cables in the feeding network for distributing the signal to the radiators. With coaxial cables, signals can cross each other without problem, but coaxial cables of practical dimensions introduce significant loss in the feeding network. A feeding network with air coaxial lines as described in WO 2005/101566 A1, now U.S. Pat. No. 7,619,580, is basically arranged in two dimensions, which means that signals cannot cross each other. This new invention therefore also, according to a preferred embodiment, provides a solution to this problem by having the signal pass through the reflector and travel along a microstrip line splitter/combiner on the reflector front side and then pass back through the reflector to the reflector back side.

The microstrip lines on the reflector front side can interact with the radiators and the adjacent lines, and thus reduce the isolation between the two channels. Means for increasing the isolation are known today. Typical solutions are parasitic elements or other arrangements on the reflector front side, but these solutions introduce additional manufacturing costs, and may not give the required isolation. A novel solution to this problem is to introduce controlled coupling between channels at the reflector back side that cancels the coupling on the antenna front side. This introduced coupling must be optimized in phase and amplitude in order to achieve efficient cancellation.

For a two-column antenna, the azimuth antenna beam shape primarily depends on a complex interaction between the width and shape of the reflector, the radiation diagram of the radiators and the separation between the radiators. Reducing the antenna beam width increases the antenna gain. It is a well-known fact that it is possible to achieve a narrower azimuth beam width by designing the outer parts of the reflector as shown in FIG. 5. This invention also, according to a further preferred embodiment, includes novel means to reduce the azimuth side lobe level by introducing a conducting ridge between the two antenna columns.

BRIEF DESCRIPTION OF THE DRAWINGS

The invention will now be described in more detail in connection with a non-limiting embodiment of the invention shown on the appended drawings, in which.

DETAILED DESCRIPTION

Figure 1:
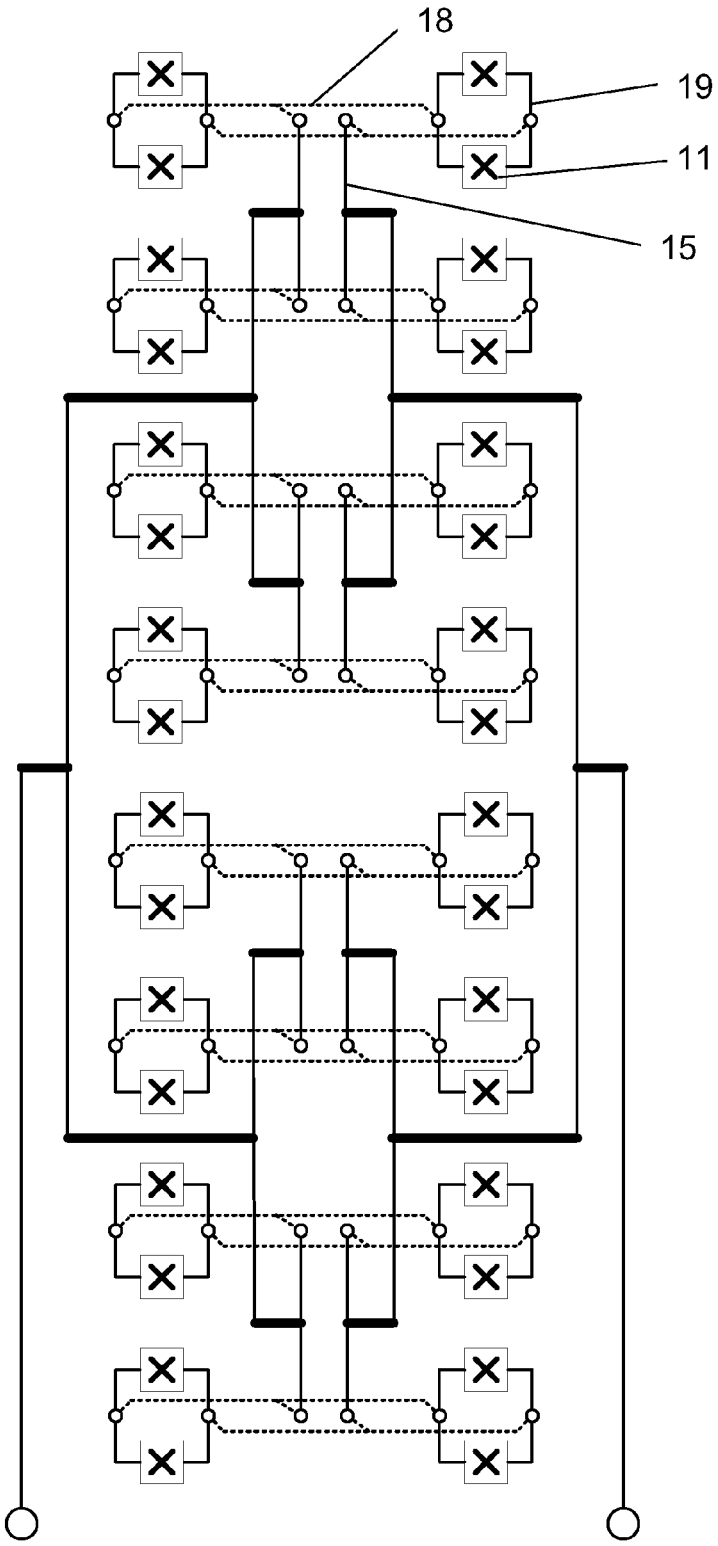
FIG. 1 shows a feeding network for a novel two-column antenna with 32 radiators.
Figure 2:
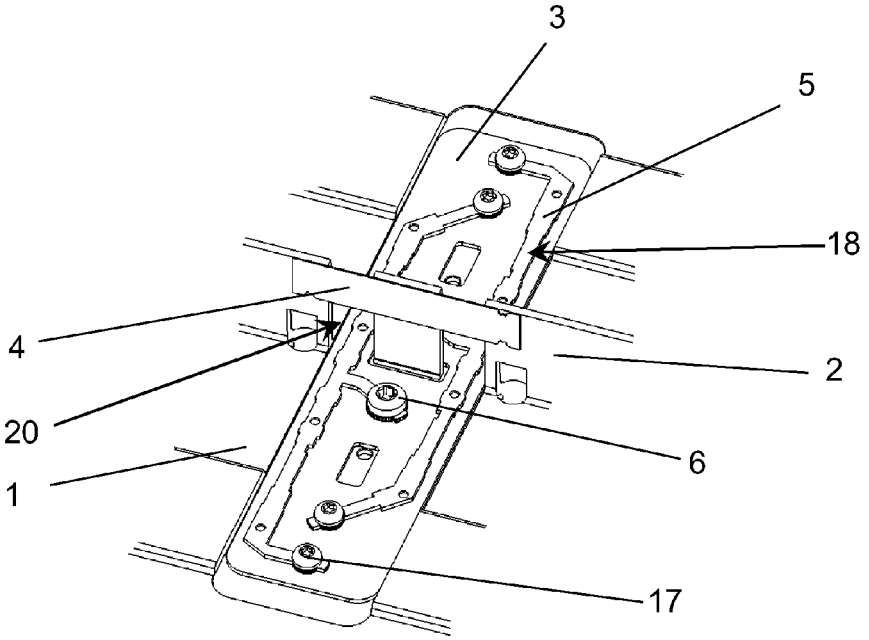
FIG. 2 shows a part of the reflector front side with a microstrip line splitter/combiner.
Figure 3:
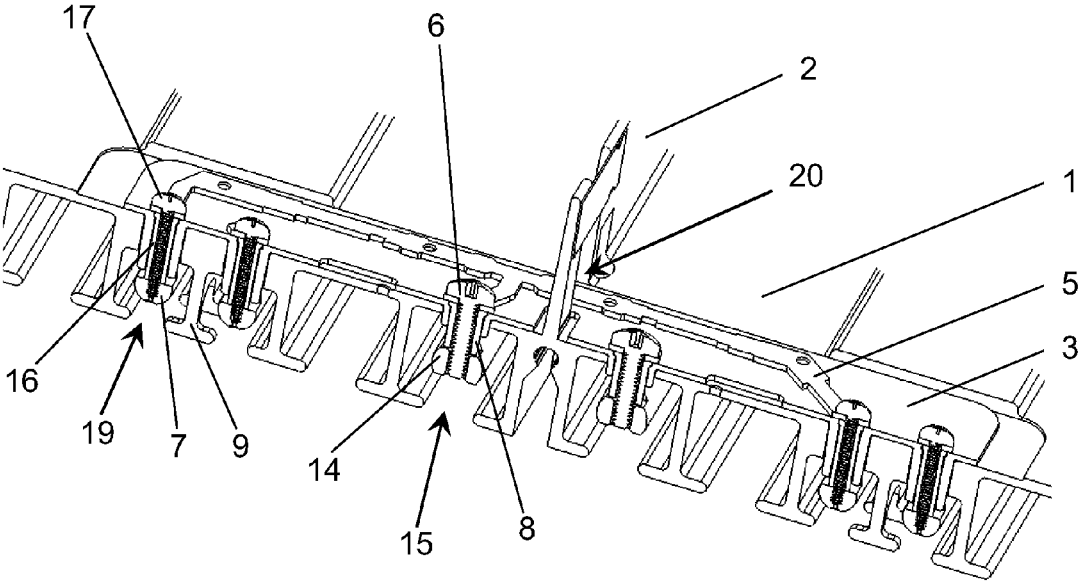
FIG. 3 shows a cross section of a part of the same splitter/combiner together with conductive spacers used to connect the microstrip line splitter/combiner with the air coaxial lines on the reflector back side.
Figure 4:
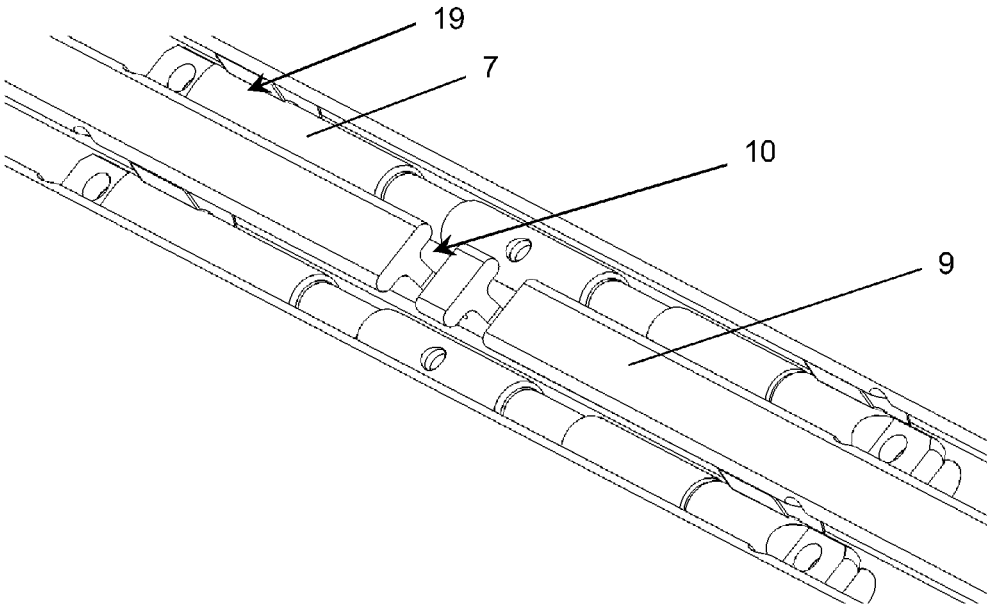
FIG. 4 shows two air coaxial lines with coupling apertures in the common outer conductor structure.

In FIGS. 2 and 3 is shown an embodiment of the microstrip line splitter/combiner arrangement 18 on the antenna reflector front side 1, but other embodiments with microstrip lines using other types of transmission lines could also be used.

The microstrip line splitter/combiner comprises a conductor 5, a dielectric isolator 3 and a ground plane. In this embodiment, the reflector 1 acts as a ground plane. The microstrip line splitters/combiners 18 also split the signal so that it can feed the radiators 11 in each antenna column. The signal enters on the air coaxial line 15. It then passes through the reflector 1 using a conductive spacer 8 that connect the coaxial line 15 inner conductor 14 to the microstrip line splitter/combiner conductor 5. The signal is then split in two, and each signal again passes the reflector via other conductive spacers 16 to the inner conductor 7 of the coaxial lines 19 that are connected to the radiators 11. The screws 6 and 17 mechanically hold the conductive spacers 8 and 16 in place between the coaxial lines inner conductors 7, 14 and the microstrip line splitter/combiner conductor 5. This is one way to connect the microstrip line splitter/combiner 18 on the reflector 1 front side to the coaxial lines 15, 19 on the reflector back side, but other ways are also possible.

Because the signals now also travel on the antenna reflector front side, signals will couple between the radiators 11 and the microstrip line splitters/combiners 18. If the dielectric isolator 3 is sufficiently thin, this coupling will be insignificant when it comes to antenna pattern and gain, but will have an effect on the isolation between the two channels. Isolation will also be reduced because of coupling between two adjacent microstrip line splitters/combiners 18.

In the air coaxial line feeding network that is used, signals from the two channels travel on the parallel coaxial lines 19 that run next to each other only separated by a common coaxial line outer conductor structure 9. By making small apertures 10 in this common outer conductor structure 9, it is possible to couple a signal from one coaxial line to the other, and thereby affect isolation between the two channels. The size of this aperture 10 will determine the amplitude of the coupled signal, and the position of the aperture will determine the phase of the signal. Thus, the cancellation mentioned above can be optimised. The main advantage is that this type of cancellation does not require any extra parts that would have added to the complexity and cost of the antenna. This arrangement can be combined with known methods for increasing polarisation isolation such as parasitic elements, the advantage being that increased isolation is achieved and the number of parasitic elements needed is reduced.

Figure 5:
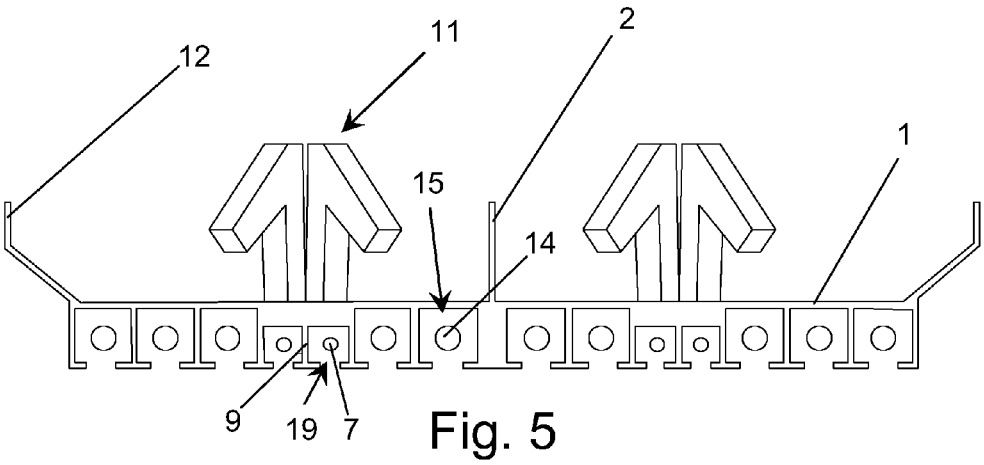
FIG. 5 shows a cross-section of a reflector having a ridge between the two dipole columns.

FIG. 5 shows the shape of the antenna reflector used in this embodiment. The reflector outer edges 12 are angled inwards in order to reduce the antenna beam width and to reduce the azimuth side lobe level. The open coaxial lines 15 and 19 included in the feeding network are integrated with the antenna reflector 1 in the same way as in applicant's earlier application WO 2005/101566 A1, now U.S. Pat. No. 7,619,580. The radiators 11 are placed on the reflector 1 front side. A conductive ridge 2 is also included in the reflector, between the two columns of radiators 11, and will reduce the azimuth side lobe level. The reflector can preferably be manufactured as an aluminium extrusion.

The microstrip line splitter/combiner 18 has to pass through the ridge 2 in order to interconnect the two antenna columns. It is therefore necessary to open up the ridge 2 where the is microstrip line splitter/combiner 18 must pass. It is important to keep those openings 20 for the microstrip lines sufficiently small to get the desired effect on azimuth side lobe level. For manufacturing reasons it is necessary to open up the full height of the ridge 2. These openings 20 significantly reduce the positive effects of the ridge. By electrically connecting the upper parts of the ridge 2, the azimuth side-lobe performance will be similar to that without openings in the ridge. The connection can be galvanically connected to the reflector ridge, or capacitively connected to the reflector ridge by means of a thin isolating layer. An embodiment of this solution is shown in FIG. 2, where a metal plate 4 with an isolating adhesive is attached to the ridge 2.

Figure 6:
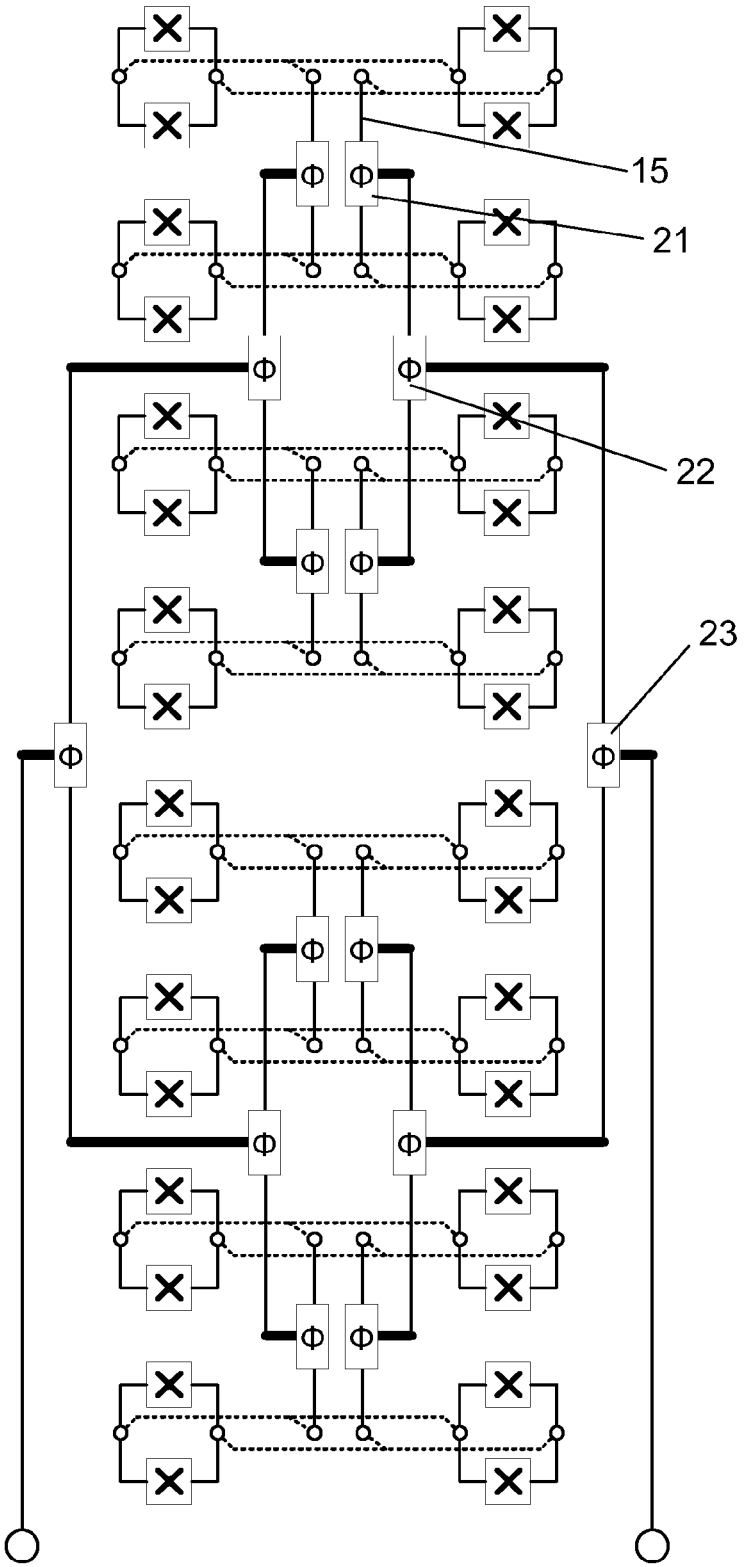
FIG. 6 shows a feeding network including phase shifters for an antenna with a variable elevation tilt angle.

In another embodiment, FIG. 6, variable differential phase shifters 21, 22, 23 are included in the two-column antenna feeding network. FIG. 6 shows how differential phase shifters 21, 22, 23 can be located within the feeding network to allow for variable elevation tilt functionality. The further details of these variable differential phase shifters are described in co-pending patent application Ser. No. 12/679,550, having the same inventors hereto, co-assigned herewith and filed on even date with the present application.

The invention claimed is:

1. A multi radiator base station antenna, comprising:

a feeding network having air filled coaxial lines (15; 19) feeding two parallel columns of radiators (11) placed on a front side of a common antenna reflector (1) such that adjacent radiators share the antenna reflector, wherein the coaxial lines are integrated into a back side of the antenna reflector (1), and wherein each of the coaxial lines comprise an outer conductor (9) and an inner conductor (7; 14); and a microstrip line (18) on the reflector (1) front side and providing a connection from a first air filled coaxial line to a second coaxial line while crossing a third coaxial line carrying a different signal from the first and second coaxial lines.

2. The antenna according to claim 1, wherein the radiators (11) are dual polarised.

3. The antenna according to claim 1 or 2, wherein the outer conductors (9) of the coaxial lines have a longitudinal slit.

4. The antenna according to claim 1 wherein the microstrip line (18) acts as a splitter/combiner.

5. The antenna according to claim 1, wherein apertures (10) have been made in the coaxial line outer conductor structure (9) separating a first coaxial line from an adjacent parallel second coaxial line, each carrying signals from separate channels, thereby coupling a signal from the first coaxial line with the signal from the second coaxial line.

6. The antenna according to any of claim 1 or 2, wherein the antenna reflector (1) has a longitudinal ridge (2) between the two radiator columns.

7. The antenna according to claim 6, wherein openings (20) are arranged in the radiator ridge (2) overbridged by a conductive plate (4) galvanically connected to the ridge (2).

8. The antenna according to claim 6, wherein openings (20) are arranged in the radiator ridge (2) overbridged by a conductive plate (4) capacitively connected to the ridge (2).

9. The antenna according to claim 1 or 2, wherein at least one adjustable phase shifter (21) using a dielectric part is arranged in the antenna and wherein the dielectric part is being movable longitudinally in relation to at least one coaxial line (15).

10. The antenna according to claim 1 wherein the second coaxial line (19) is connected to a first radiator located in a first of the two parallel columns of radiators and the microstrip line is further connected to a third coaxial line connected to a second radiator located in a second of the two parallel columns of radiators.

11. The antenna according to claim 3 wherein the microstrip line (18) acts as a splitter/combiner.

12. The antenna according to claim 3, wherein apertures (10) have been made in the coaxial line outer conductor structure (9) separating a first coaxial line from an adjacent parallel second coaxial line, each carrying signals from separate channels, thereby coupling a signal from the first coaxial line with the signal from the second coaxial line.

13. The antenna according to claim 3 wherein the second coaxial line (19) is connected to a first radiator located in a first of the two parallel columns of radiators and the microstrip line is further connected to a third coaxial line connected to a second radiator located in a second of the two parallel columns of radiators.

* * * * *